US009844695B1

(12) United States Patent
Shorter

(10) Patent No.: US 9,844,695 B1
(45) Date of Patent: Dec. 19, 2017

(54) MULTI-CONFIGURATION UPGRADABLE FITNESS DEVICE

(71) Applicant: Gary Thomas Shorter, Lombard, IL (US)

(72) Inventor: Gary Thomas Shorter, Lombard, IL (US)

( * ) Notice: Subject to any disclaimer, the term of this patent is extended or adjusted under 35 U.S.C. 154(b) by 49 days.

(21) Appl. No.: 15/061,536

(22) Filed: Mar. 4, 2016

Related U.S. Application Data

(60) Provisional application No. 62/129,381, filed on Mar. 6, 2015.

(51) Int. Cl.
*A63B 21/072* (2006.01)
*A63B 21/075* (2006.01)
*A63B 21/06* (2006.01)

(52) U.S. Cl.
CPC ..... *A63B 21/075* (2013.01); *A63B 21/0726* (2013.01); *A63B 21/0605* (2013.01); *A63B 21/072* (2013.01); *A63B 21/0722* (2015.10)

(58) Field of Classification Search
CPC ..... A63B 21/075; A63B 21/0726; A63B 21/0004; A63B 21/00058; A63B 21/00061; A63B 21/00065; A63B 21/06; A63B 21/0601; A63B 21/0605; A63B 21/072; A63B 21/0722; A63B 21/0724; A63B 21/0728
See application file for complete search history.

(56) References Cited

U.S. PATENT DOCUMENTS

| | | | | |
|---|---|---|---|---|
| 1,917,566 | A * | 7/1933 | Wood | A63B 21/075 482/108 |
| 6,387,022 | B1 | 5/2002 | Smith | |
| 7,238,147 | B2 | 7/2007 | Mills | |
| 7,381,157 | B2 | 6/2008 | Blateri | |
| 7,563,208 | B1 * | 7/2009 | Chen | A63B 21/075 482/108 |
| 7,993,250 | B2 | 8/2011 | Abbott | |
| 8,128,537 | B2 | 3/2012 | Signorile | |
| 8,568,280 | B2 * | 10/2013 | Mendoza | A63B 21/072 482/108 |
| 8,636,625 | B2 | 1/2014 | Johnson | |
| 2008/0081744 | A1 * | 4/2008 | Gormley | A63B 21/0728 482/93 |
| 2010/0210427 | A1 * | 8/2010 | Yu | A63B 21/075 482/93 |
| 2011/0263392 | A1 * | 10/2011 | Yu | A63B 21/072 482/93 |

(Continued)

*Primary Examiner* — Loan H Thanh
*Assistant Examiner* — Megan Anderson

(57) ABSTRACT

The present invention is new in the art as a multi-configuration upgradable fitness device, which can be configured with none, one or more handle(s) attached around a 0-degree to 360-degree rotational position about a central axis as a best mode and configured for operation into (5) fitness devices not limited to; 1) an exercise ball (no handles), 2) kettle bell (1 handle), 3) medicine ball (2 handles opposite), 4) kettle bell-2 (2 handles near each other) and 5) dumbbell (1 handle to a side), and can be upgraded from 2.5 pounds of weights to 10 pounds and up to 50 pounds in increments of 2.5 pounds from (1) to (20) weights to enable 100 or more configurations of fitness equipment as a best mode that enables over one-hundred fitness exercises with this single device as detailed in the entire disclosure.

20 Claims, 14 Drawing Sheets

(56) References Cited

U.S. PATENT DOCUMENTS

| | | | | |
|---|---|---|---|---|
| 2011/0263393 | A1 | 10/2011 | Ross | |
| 2012/0046148 | A1 | 2/2012 | Aguila | |
| 2013/0040789 | A1* | 2/2013 | Kessler | A63B 21/072<br>482/108 |

* cited by examiner

Front View

Top View

Front View

Cradle

MULTI-CONFIGURATION UPGRADABLE FITNESS DEVICE

FIELD OF INVENTION

The present invention relates to a fitness device for general and specific exercises and wellness conditioning.

BACKGROUND

The present invention pertains to fitness and exercise devices, which can have multiple configurations as; 1) no handle like an exercise ball, 2) 1-handle like a kettle bell, 3) 2-handles opposite like a medicine ball, 4) 2-handles next to each other as a best mode for a 2-handle kettle bell-2, and 5) 1-handle to a side like a dumbbell, with a handle attachment from 0-degrees to 360-degrees rotation about an axis to enable a best mode and multiple number of handle configurations, with either no added weight, or one or multiple weights selectable by the user, as an upgradable weight system that can be in increments of 2.5 pounds to 50 pounds (more or less) that when combined with the multiple handle configurations enables (100) or more fitness and exercise equipment configurations in this one device.

SUMMARY OF INVENTION

Fitness and exercise devices, partial enclosures, handles and weights are generally disclosed. Some example embodiments can include methods, apparatus, and/or systems pertaining to exercise ball, kettle bell, medicine ball, kettle bell-2, dumb bell, connection system, upgradable weight system, devices, and multiple configurations in a single device.

The disclosed invention contains a series of components that can include but not limited to weighted disc(s), upgrade weighted disc(s), weighted handle(s), end cap(s), connection system(s), weight calibration that combined enables a multiple of device configurations.

The disclosed invention enables a best mode of (100 or more) different exercise equipment configurations with the (5) handle configurations multiplied by the (1 2, 3, 4, . . . 20 or more) upgradable weight increments of 2.5 pounds to approximately 50 pounds.

The disclosed invention can utilize 0, 1 or more attached handle(s) in (5) configurations is a best mode that enables; 1) exercise ball (no handle), 2) kettle bell (1 handle), 3) medicine ball (2 handles opposite), 4) kettle bell-2 (2 handles near each other) and 5) dumbbell (1 handle at side) that can be attached in a best mode circular rotation from 0 degrees to 360 degrees about an axis to enable the best mode handle attachment.

The disclosed invention can have components that include and are not limited to a connection system as an illustration of a best mode that can contain stretch band(s), male/female snap(s), grab loop(s), hinge mechanism, alignment shaft, weighted disc(s), handle(s) with attraction surface with an adhesive/magnetic type coating and end caps to enable a flexible connection mechanism that will ensure the device is securely connected with any amount or thickness of variable weights contained within.

The disclosed invention can provide an upgradable weight system of components as 2.5 lb weighted discs, 5 lb weighted upgrade discs and 2.5 lb weighted handles that can be configured in (1, 2, 3, 4, . . . 20 or more) 2.5 lb increments of 2.5 pounds to approximately 50 pounds of user selectable weight(s) as a best mode of upgradable weight flexibility with a weight calibration on the end cap(s) to provide a convenient best mode to visually determine the amount of variable weight in the device.

The disclosed invention can provide an assembly cradle for changing configurations of the (5) handle configurations and the (1, 2, 3, 4, . . . 20 or more) increments of weight(s) to enable (100 more or less) different configurations of fitness and exercise devices and a weight calibration along the lading edge to enable a best mode to visually determination the amount of variable weight in the assembly cradle and can be used as a storage platform from 2.5 lbs to 100 lbs or more of weighted discs, upgrade discs and weighted handles in a single cradle that can be stacked vertically upon another cradle about its (4) feet and (4) vertical support posts to enable a convenient space saving storage and assembly platform.

The disclosed invention can enable 100's of fitness exercises as a best mode with its (5) handle configurations combined with the (1, 2, 3, 4, . . . 20) increments of weight adjustments to provide (100 more or less) difference configurations of fitness equipment as a best mode exercise solution in a single device.

BRIEF DESCRIPTION OF THE PRIOR ART

The prior art of record fails to teach a multi-configurable exercise device in combination with all the structural and functional limitations and further comprising a plurality of straps, where the plurality of straps connect a top and bottom ends of the end caps together. The closest prior are of record includes Blateri (U.S. Pat. No. 7,381,157), Mendoza (U.S. Pat. No. 8,568,280), Chen (U.S. Pat. No. 7,563,208), and Kessler (US 2013/0040789).

Blateri discloses an exercise device with two end caps (12, 24), an upgradable alignment shaft (16), an expansion alignment shaft (28), a plurality of weight discs and a plurality of upgradable weight discs (30*a*-30*d*), a handle (14). Blateri fails to disclose a plurality of weight handle discs and a plurality of straps.

Mendoza discloses two end caps (1,2), an upgradable alignment shaft (9), an expansion alignment shaft (9, see FIG. 4), a plurality of weight discs (6) and a pair of handles (see FIG. 2). The device of Mendoza is held together through a clip fastener (32) shown in FIG. 1. Mendoza fails to disclose a plurality of weight handle discs and a plurality of straps to hold the device together.

Chen discloses an adjustable kettlebell with two end caps (13 and 12), an alignment shaft (20), an expansion alignment shaft (30), a plurality of weight discs (40) and a plurality of upgrade weight discs (31), and a plurality of handle discs (51, 52). The device of Chen is held together when the shaft (20) of the device is screwed into the handle (23).

Kessler discloses a soft sided kettlebell, with an end cap (42) and a body (14), with a weight (82) and a plurality of straps (62A and 62B) that hold the end cap to the body of the kettlebell. However, it would not be obvious to modify the devices of Blateri, Mendoza, and Chen to have straps holding various devices together, because the straps would not be able to hold as much weight as the devices of Blateri, Mendoza and Chen. Further, the devices of Chen and Blateri do not have touching end caps.

U.S. Pat. No. 8,267,841 discloses a dumbbell having transverse connection(s) between two weights, support bars and release mechanism in a preferred clam-shell form. Where my invention is not limited to just two weights and only a dumbbell configuration, but gives the user (20) more or less combinations of fitness equipment with an upgradable weight system from as little as 2.5 pounds in one weight to 50 pounds more or less of weight in a wide variety of 100's of fitness exercises.

U.S. Pat. No. 8,568,280 discloses a separate weight adjustable medicine ball primarily composed of two pieces, separated to perform dumbbell exercises, push-up handles, or combined to perform medicine ball exercises. The present invention allows the user to incrementally increase the exercising load with a plurality of weights, secured by collar clamps and supports. Where my invention is not limited to just a medicine ball or dumbbell configuration but gives the user (20) more or less combinations of fitness equipment with an upgradable weight system from a single weight to a plurality of incremental weights of 50 pounds more or less for a wide variety of 100's of fitness exercises.

U.S. Pat. No. 8,128,537 discloses handheld, vibratory selectively removable modular weights for incorporating an adjustable and additional resistance. The present invention is a vibratory system with a hand-held resistance device that can have a pendulous shape of "low center of gravity" or "low center of mass" and adjustable weights and thereby provides the opportunity for a unique, multi-faceted neuro-muscular load. Where my invention is not a vibratory device with just one fixed handle as in 537, but a new design with easily changed handles attached from 0 to 360 degrees through an alignment shaft with an upgradable weight system producing a wide variety of over (100) user defined combinations.

U.S. Pat. No. 7,993,250 discloses an exercise ball with handles which facilitates an abdominal, chest and arm workout. The exercise ball is a pliable material inflated and having a pair of handles oppositely positioned on a support rod extending through the exercise ball. The exercise ball rotates relative to the handles. Resistance bands attach to the handles on one end and a user's feet on the other end to provide added resistance. Where my invention is not a rolling ball with a shaft as in 250, but a unique combination of (5) weight-adjustable exercise devices with (0-4) slip-on/off handles providing a wider variety of over (100) exercise combinations.

U.S. Pat. No. 7,381,157 discloses an exercise device according to which at least one weight is disposed in the enclosure and is locked in the enclosure with screwed-in weights and a fixed handle atop the spherical enclosure. Where my invention does not use a screw mechanism to hold the weights and the handles are removable and can be located at 0 degrees to 360 degrees.

U.S. Pat. No. 7,238,147 discloses an exercise device in which removable weight can be provided in a housing of the device. Two rotatable handles can be provided in the housing, permitting various hand orientations during exercise. The removable weight can be received within and/or removed from a cavity of the device. Where my invention is not a complex fixed handle assembly as in 147, but a novel approach to easily detachable (0-4) handles in a ball-type end caps with more adjustable weights providing over (100) user selectable combinations.

U.S. Pat. No. 6,387,022 discloses an adjustable weight ball for exercising having a cavity where an adjustable number of weights can be secured. There is included a cap that fits over an opening with a handle on one side of the cap and a threaded stem extending away from an opposite side. Barbell weights having a central aperture are mountable on the stem. The free end of the stem is screwed into a nut secured on the floor of the cavity. Where my invention is not just a fixed handle and weights as in 022, but a new mechanism to easily attach (0-4) handles at 0 degrees to 360 degrees through an alignment shaft with upgradable weights providing over (100) useful combinations.

U.S. Pat. No. 8,568,280 B2 discloses a separable weight adjustable medicine ball, primarily comprised of two pieces, which can either be separated to perform exercises that involve dumbbells or push-up handles or be combined to perform exercises that involve a medicine ball and allows a user to incrementally increase the exercising load with a plurality of weights. The plurality of weights is separated between the two pieces and held in place with a pair of weight supports and secured on the pair of weight supports with a pair of collar clamps that can be opened by squeezing the sides of the collar clamp and closed by releasing the sides of the collar clamp. Where my new invention does not use fixed handle(s) and a screw shaft with collar clamps as in 024, but is a novel design with a multitude of systems integrated into a device with flexible handle(s) attachments and an upgradable weight system to provide the user with over (100) combinations.

U.S. Pat. No. 8,636,625 B2 discloses a weighted exercise ball with handles on each side of the ball which rotate 360 degrees clockwise or counter clockwise. The handles alleviate stress on the wrists and provide a firm grip. The ball has inner compartments that slide outward and allows for the entry of weights of various sizes. Where my new invention is not 2-fixed handles with a slide out inner compartment as in 270, but a new design with a multi-part connection system integrated into the device with multiple handle attachments and a wide variety of weights to offer over (100) user friendly combinations.

U.S. Pat. Appl. No. 2011/0263,393 discloses an adjustable-weight exercise device which includes an exercise device body; a generally cylindrical cavity extending into the exercise device body and comprising at least one engagement feature; and a generally cylindrical weight insert configured to be slid into the cavity. The device comprises a corresponding engagement feature which can be configured to engage each other to selectively retain the generally cylindrical weight insert within the generally cylindrical cavity. Where my invention is not a cylinder shape with individual cylinder shaped weight inserts as in 393, but a unique ball-type device with a flat bottom for stable loading of weights and (0-4) easily attached handles in any combination at 0 degrees to 360 degrees delivering more than (100) user-friendly combinations U.S. Pat. Appl. No. 2012/0046,148 discloses an application for a dual use weight lifting apparatus includes a first independent weighted portion and a second independent weighted portion. Each of the independent weighted portions has handles suitable for grasping by a user and each of the independent weighted portions has a mating surface opposing the handles. The apparatus includes a way to remove the independent weighted portions together at the mating surfaces, thereby forming a joined weight lifting apparatus. The independent weighted portions are used as kettle weights when disconnected and as medicine balls when connected. Where my invention is not a single fixed handle as just a kettle bell as in 148, but a new design with (5) handle configurations as an exercise ball (no handles), kettle bell (1-handle), kettle bell-2 (2-handles near each other), medicine ball (2-opposing handles) and dumbbell (1-handle to the side) and a wider range of weights from the upgradable weight system delivering over (100) combinations.

BRIEF DESCRIPTION OF THE DRAWINGS

The forgoing and other features of the present invention will become more fully apparent from the following description, taken in conjunction with the accompanying drawings. Understanding that these drawings depict only several embodiments in accordance with the invention and are therefore, not to be considered limiting of its scope. The invention will be described with additional detail through use of the accompanying drawings.

In the drawings:

Figure 1:
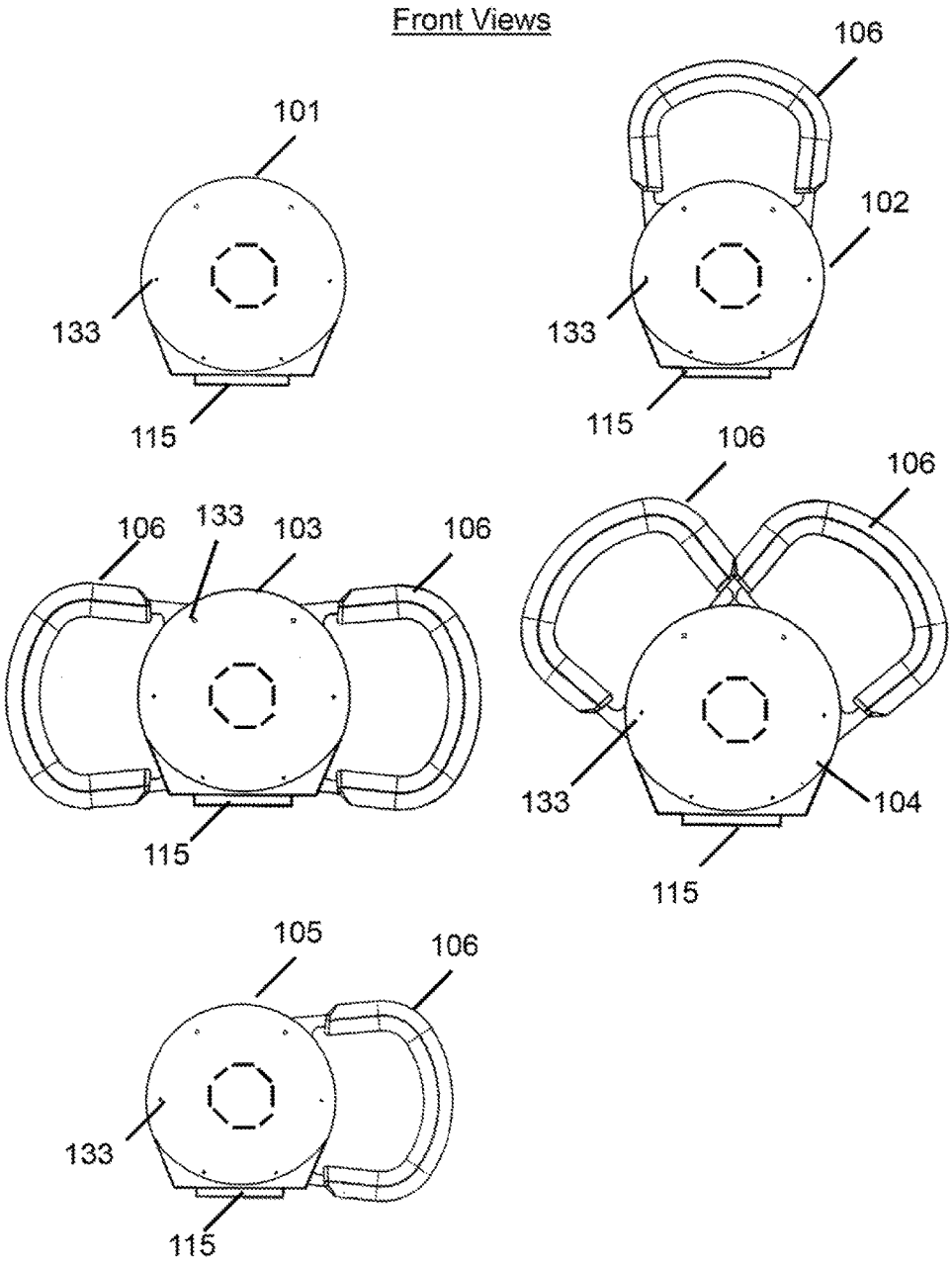

Reference is made to the following details:

101—Exercise ball configuration (no handles)
102—Kettle Bell configuration (1 handle)
103—Medicine Ball configuration (2 handles opposite)
104—Kettle Bell-2 configurations (2 handles near each other)
105—Dumbbell configuration (1 handle to the side)
106—Weighted handle/disc
107—Aligment Shaft
108—End Cap
109—Weighted disc (2.5 Lb)
110—Circular hole at center for circular alignment shaft in weighted disc (2.5 Lb)
111—Octagon 8-sided hole at center for octagon alignment shaft in weighted handle/disc (2.5 Lb)
112—Alignment Shaft support
113—Weighted upgrade disc (5 Lb)
114—Circular hole at center for circular alignment shaft in weighted upgrade disc (5 Lb)
115—Flat bottom of end cap
116—Weight calibration of 10 lbs per inch width of weighted disc(s) between end caps
117—Male snap in Connector System
118—Female snap in Connector System
119—Grab loop in Connector System
120—Stretch band in Connector System
121—Male snap in Hinge System
122—Female snap in Hinge System
123—Stretch band in Hinge System
124—Fastener hole in Connector System
125—Cover plate for end cap
126—Octagon 8-sided hole in cover plate for alignment shaft
127—Fastener hole in alignment shaft
128—(4) Fastener holes in cover plate
129—Fastener hole in alignment shaft support
130—Connector System attraction coating of adhesive/magnetic substance
131—(4) Fastener holes in end cap support structure to attach cover plate
132—Octagon 8-sided hole for octagon alignment shaft in Kettle Bell-2 (2-handles on 1-disc)
133—Holes in end, cap exterior curved surface
134—Octagon 8-sided hole for octagon alignment shaft in Medicine Ball (2-handles on 1-disc)
135—Expansion sleeve for alignment shaft
136—Expansion alignment shaft
137—Keyway in expansion sleeve
138—Connector pin in alignment shaft
139—Inner support ring for cover plate
140—Fastener for stretch band of Connector System at top of end cap
141—Fastener for stretch band of Hinge System at bottom of end cap
142—Feet of cradle
143—Vertical support post of cradle
144—Horizontal support bar of cradle
145—Cross member of cradle
146 . . . Handle of cradle
147—Visual weight calibration in 10 pounds per inch (0-12 inches) along the horizontal support
148—Top stacking position of the cradle(s)

FIG. 1 is a front view of (5) configurations as an; 1) exercise ball (no handles), 2) kettle bell (1 handle at top), 3) medicine ball (2 handles opposite), 4) kettle bell-2™ (2 handles near each other) and 5) dumb bell (1 handle at side).

Figure 2:
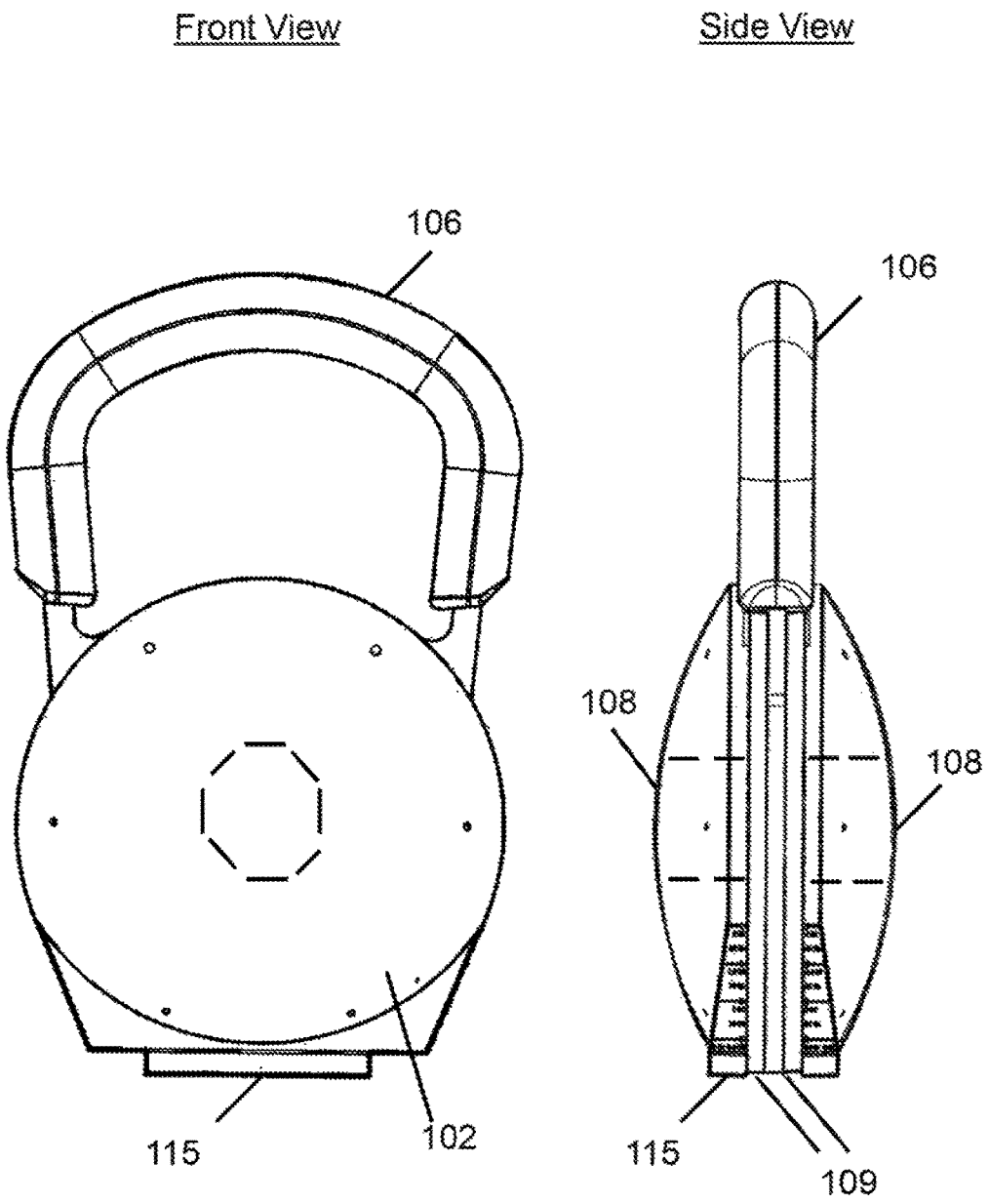

FIG. 2 is a front and side view example of an assembled kettle bell with handle at top.

Figure 3:
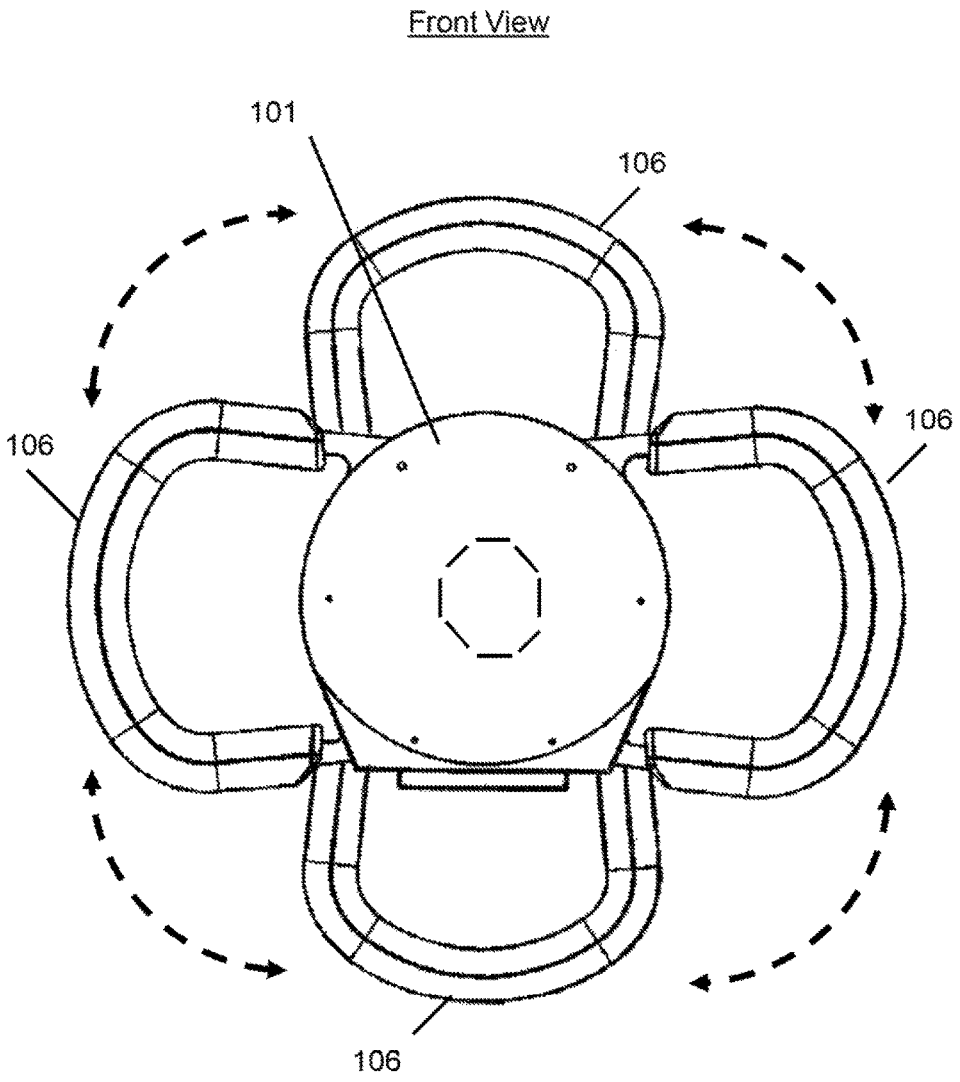

FIG. 3 is a front view of handle(s) rotating about an axis of an exercise ball from 0 degrees to 360 degrees in 8 increments at 45, 90, 135, 180, 225, 270, 315, 360 degrees.

Figure 4:
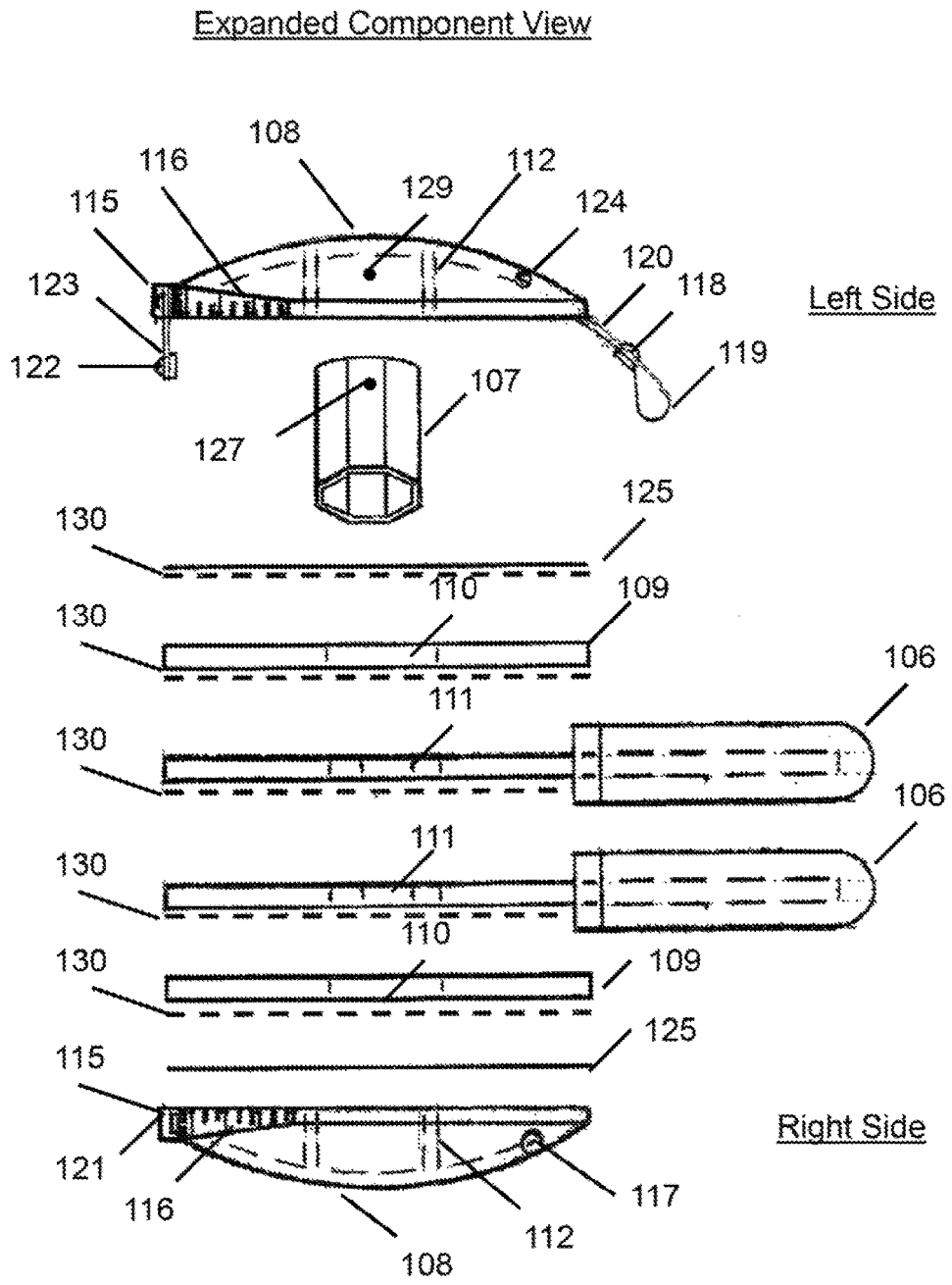

FIG. 4 is an expanded view of the (4) primary components (connector system, end caps, handles and weighted discs) of the invention.

Figure 5:
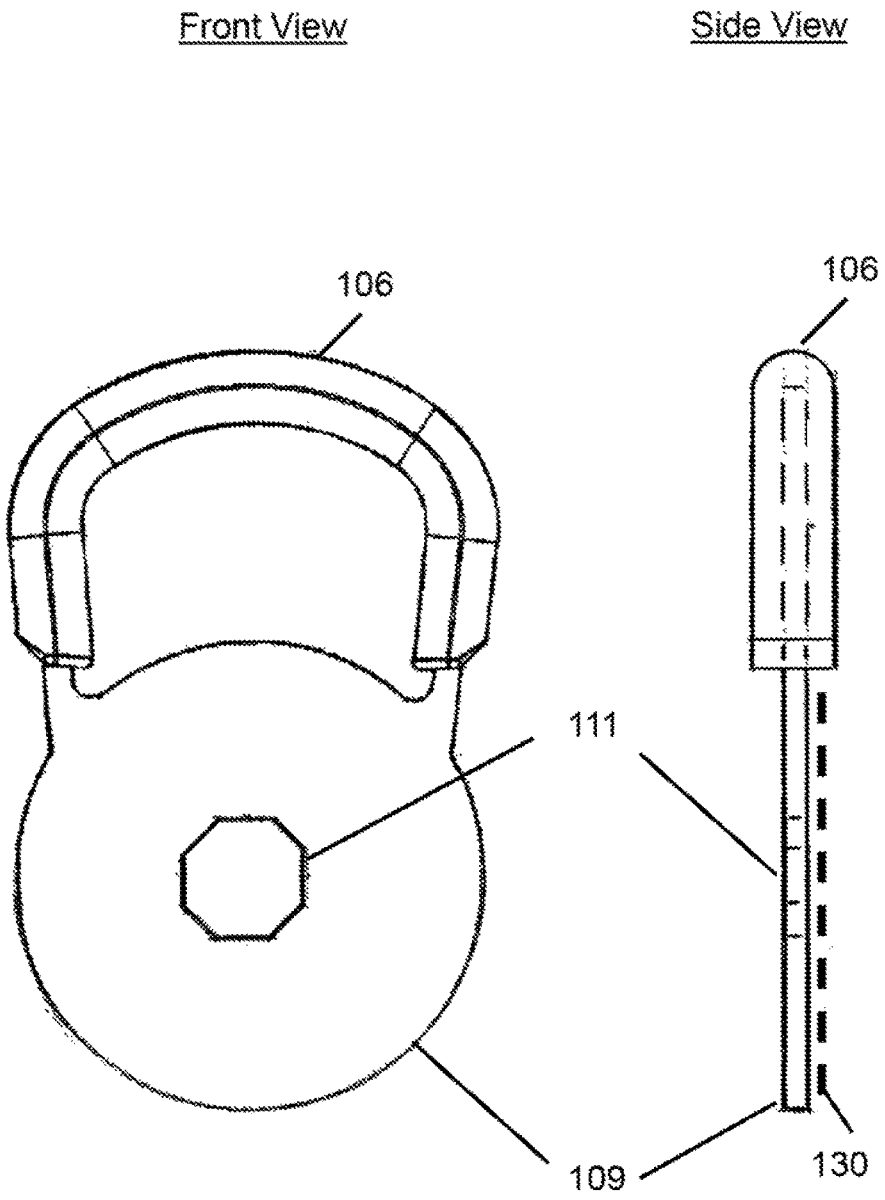

FIG. 5 is a front and side view of the weighted handle.

Figure 6:
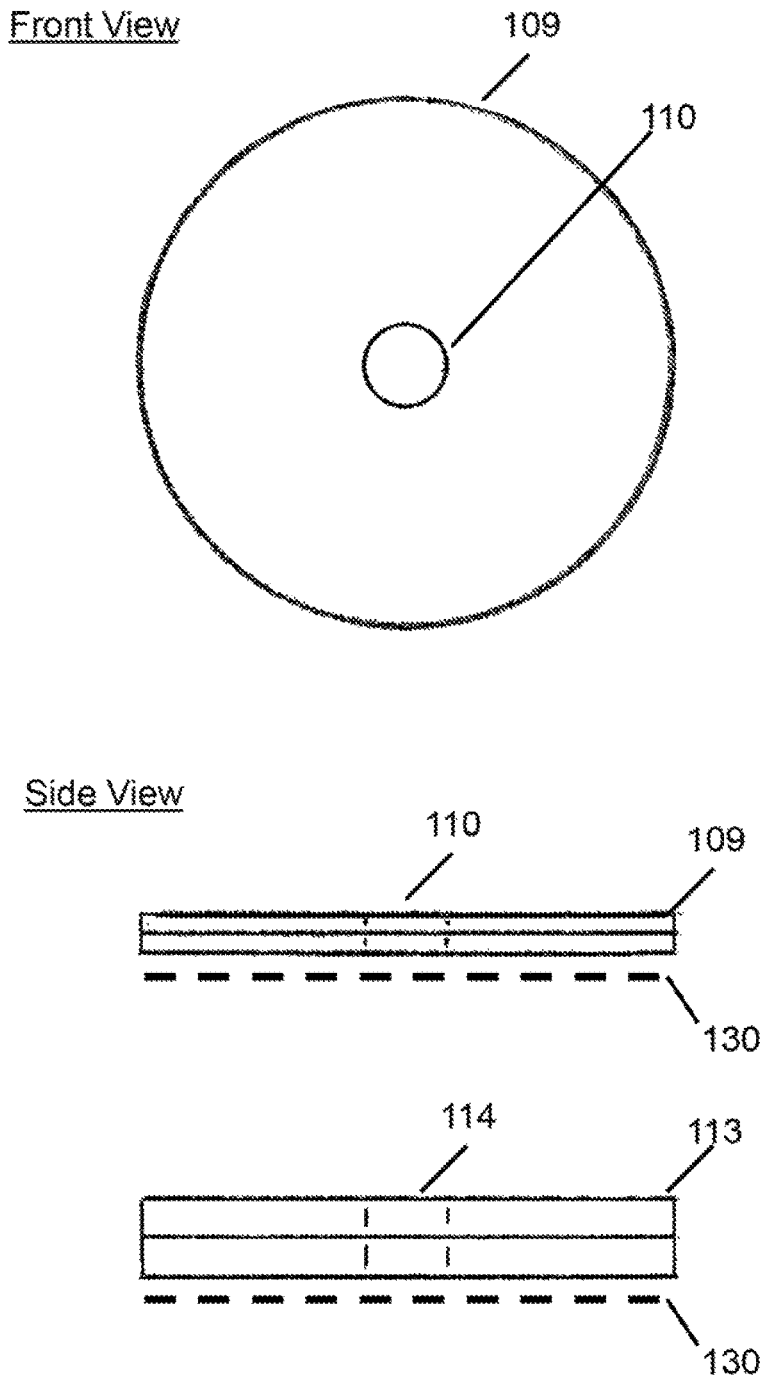

FIG. 6 is a front and side view of the weighted disc(s) and upgrade weighted disc(s).

Figure 7:
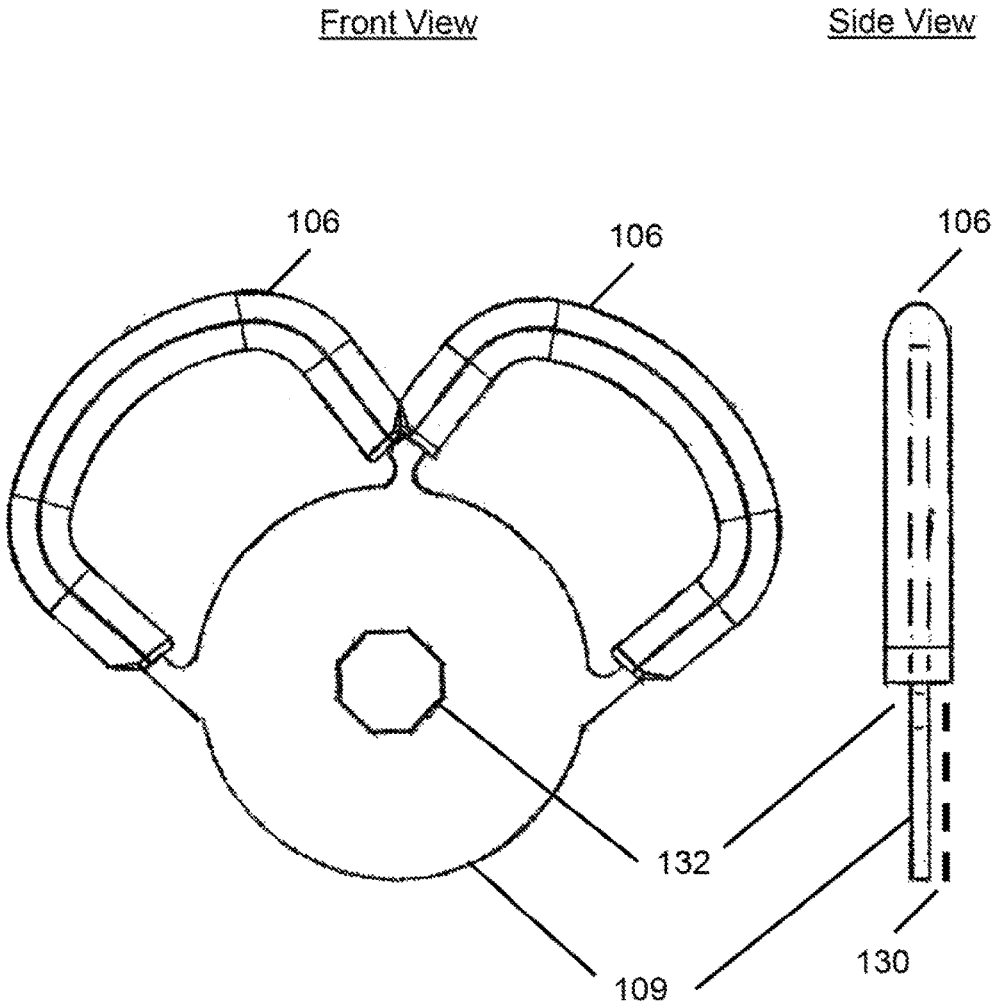

FIG. 7 is a front and side view of a 2-handle kettle bell-2 configuration with 1-disc.

Figure 8:
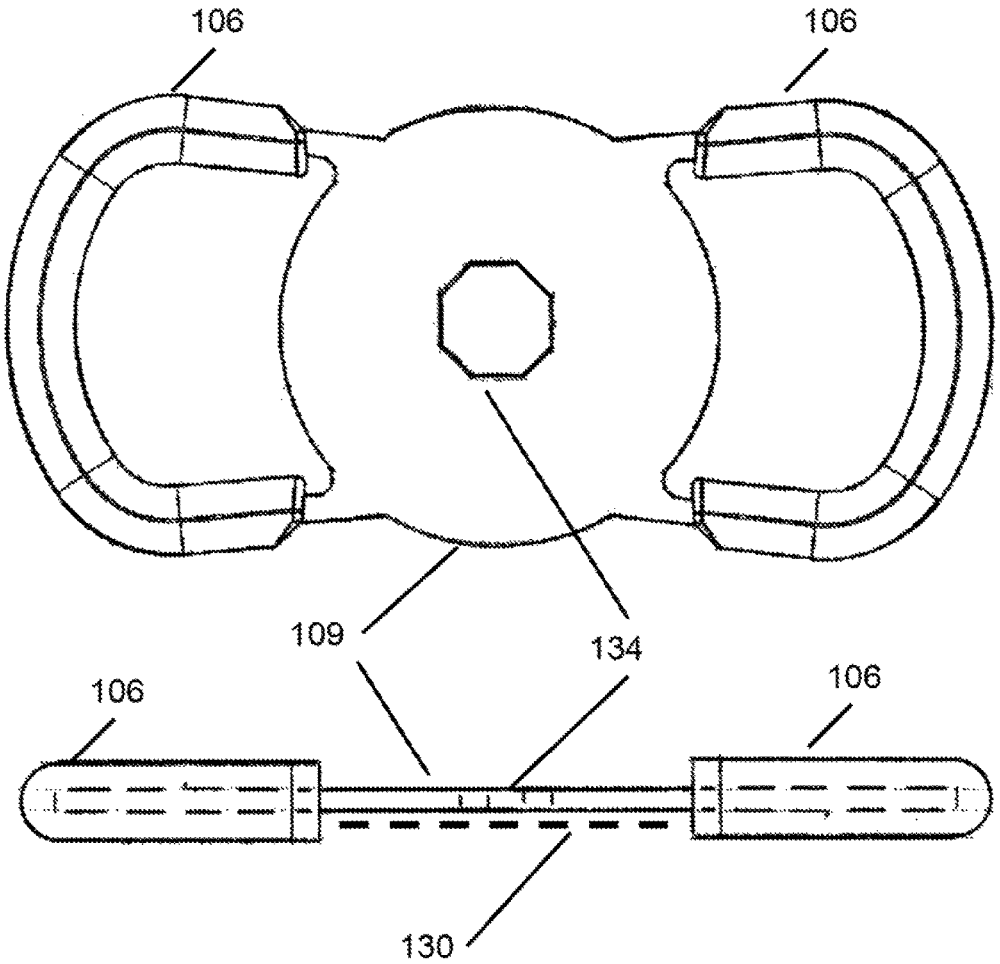

FIG. 8 is a front and side view of a 2-handle medicine ball configuration with 1-disc.

Figure 9:
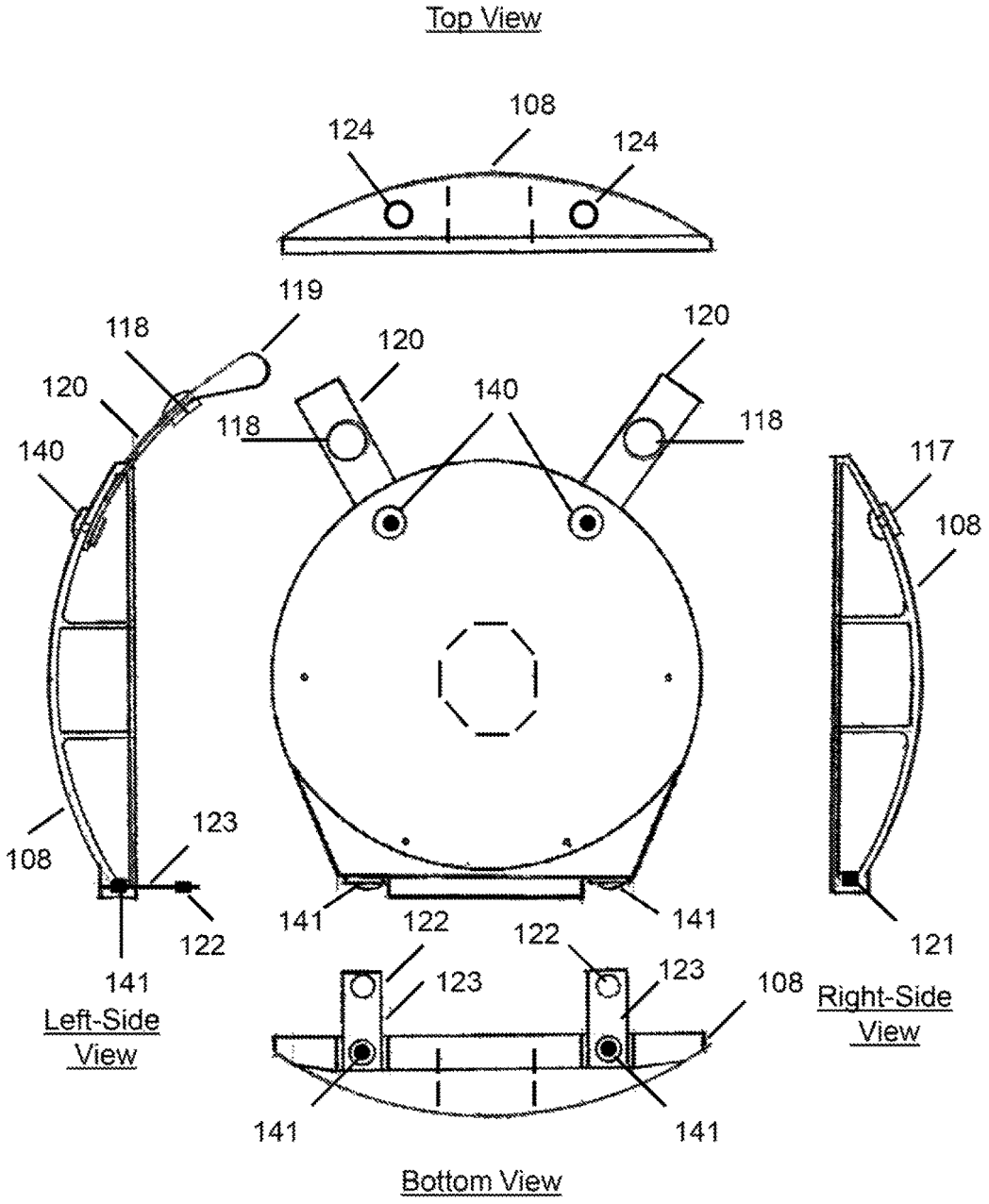
Figure 10:
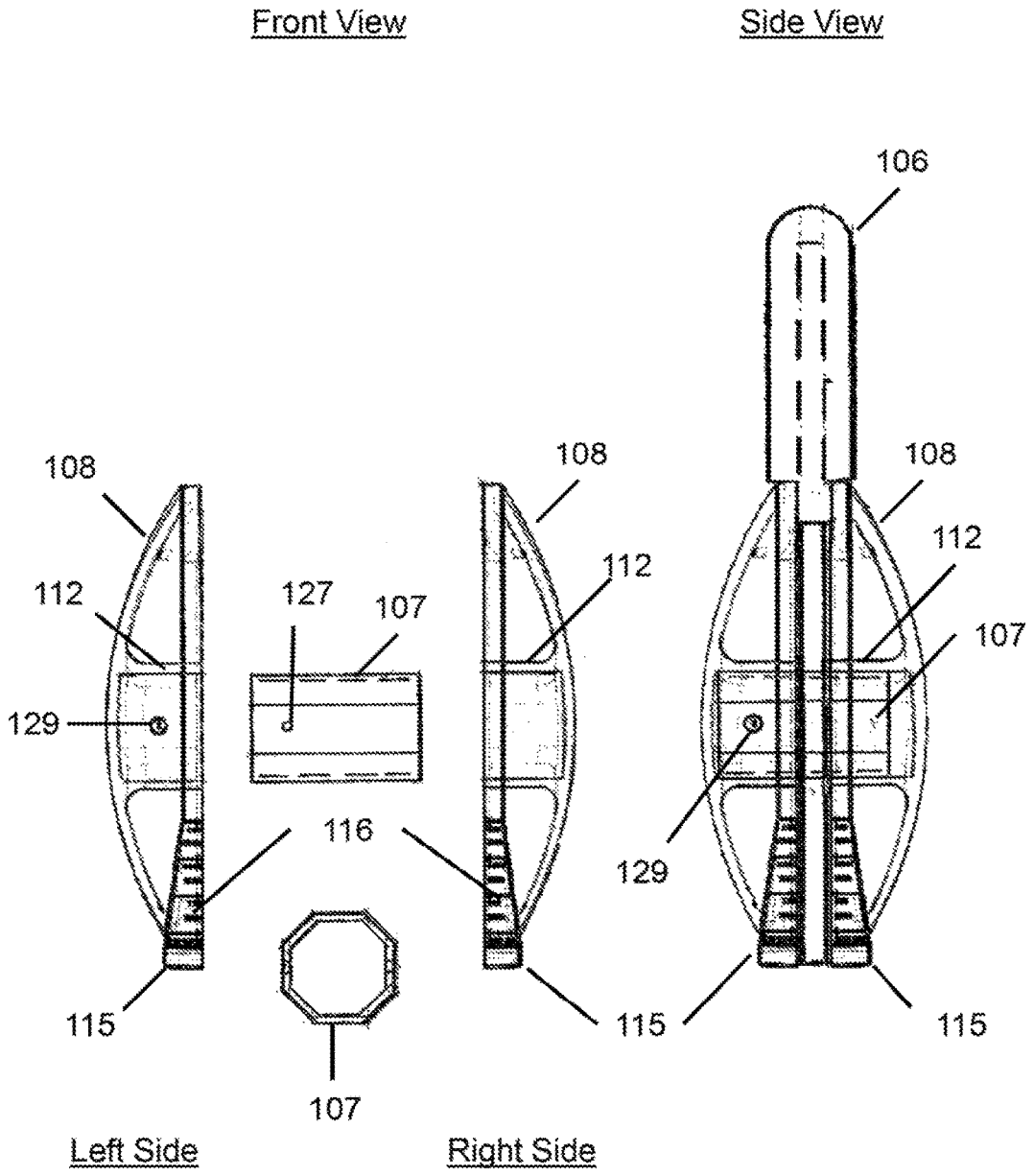
Figure 11:
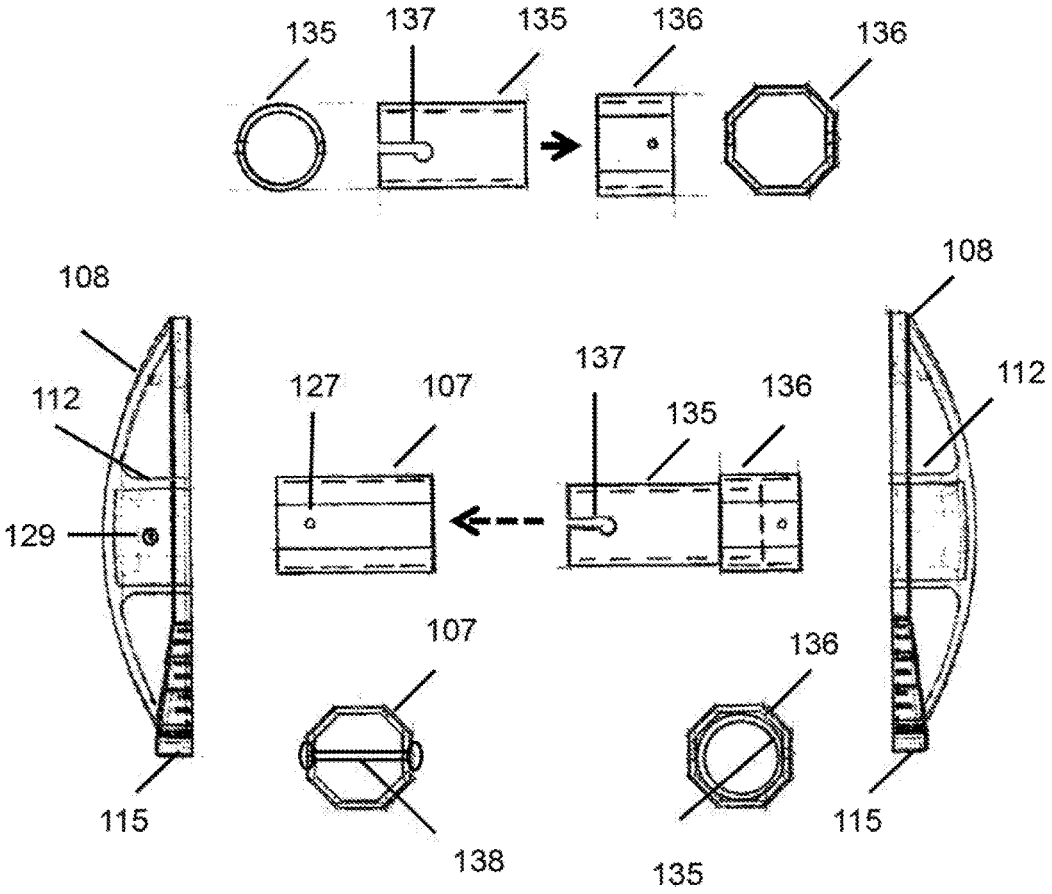
Figure 12:
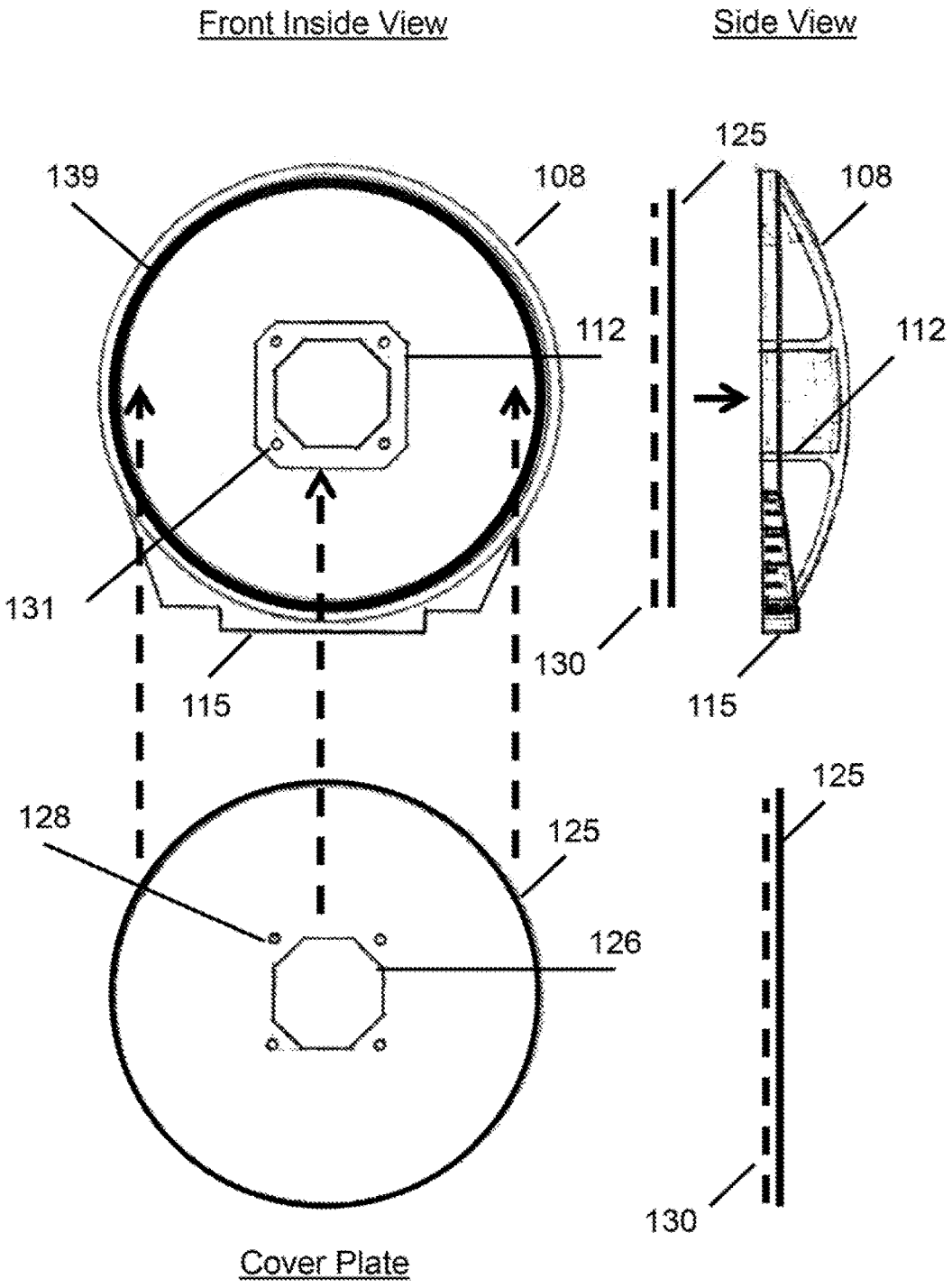
Figure 13:
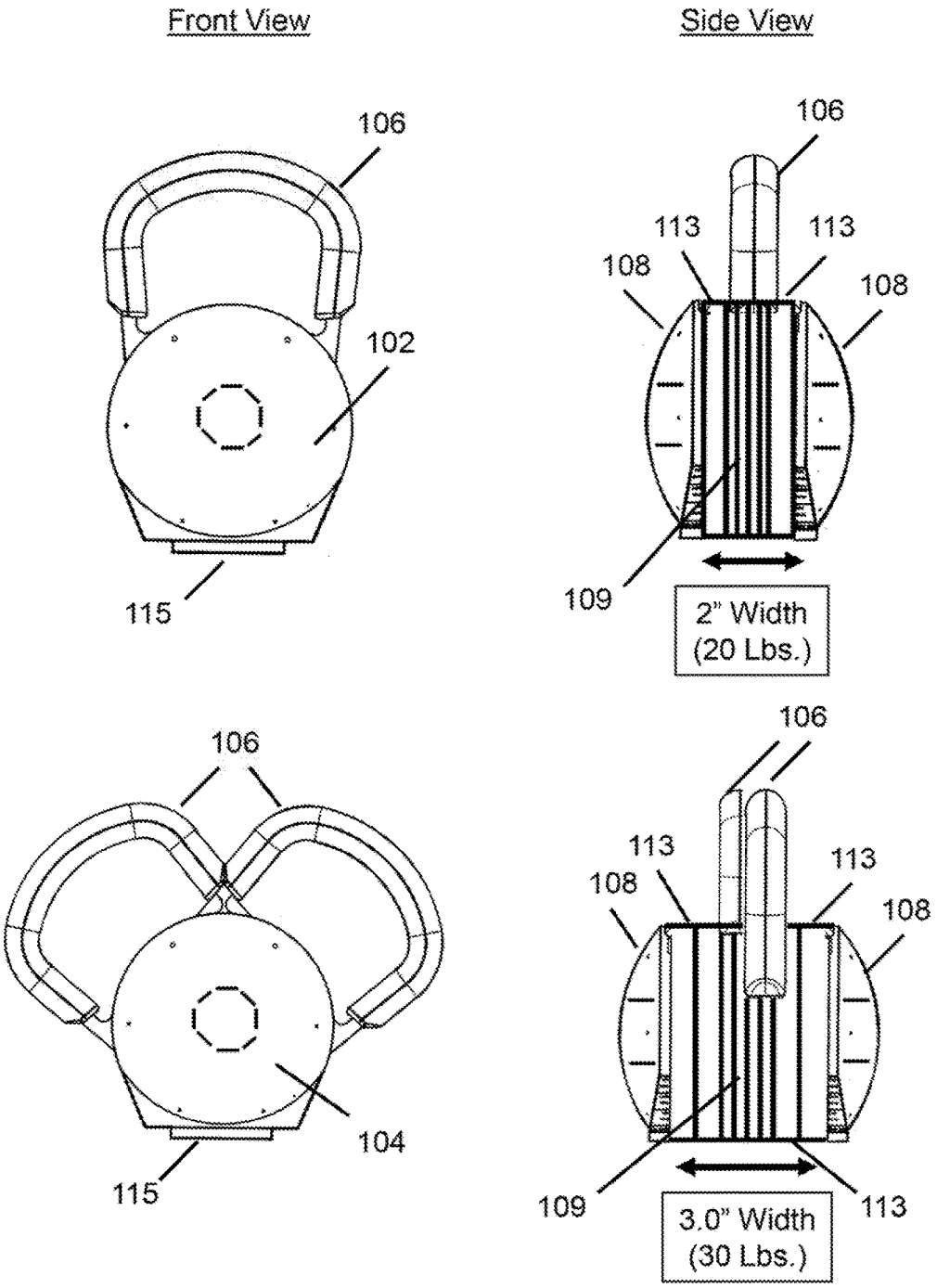

FIG. 9 is a front, top, bottom and side view of the end caps and connection system FIG. 10 is a front and side view of the alignment shaft in end caps FIG. 11 is an expanded view of the alignment shaft, expansion shaft and end caps FIG. 12 is a front and side view of the cover plate in the end cap FIG. 13 is a front and side view of the multiple upgradable configurations demonstrated as a 20 lb kettle bell and 30 lb kettle bell-2™.

Figure 14:
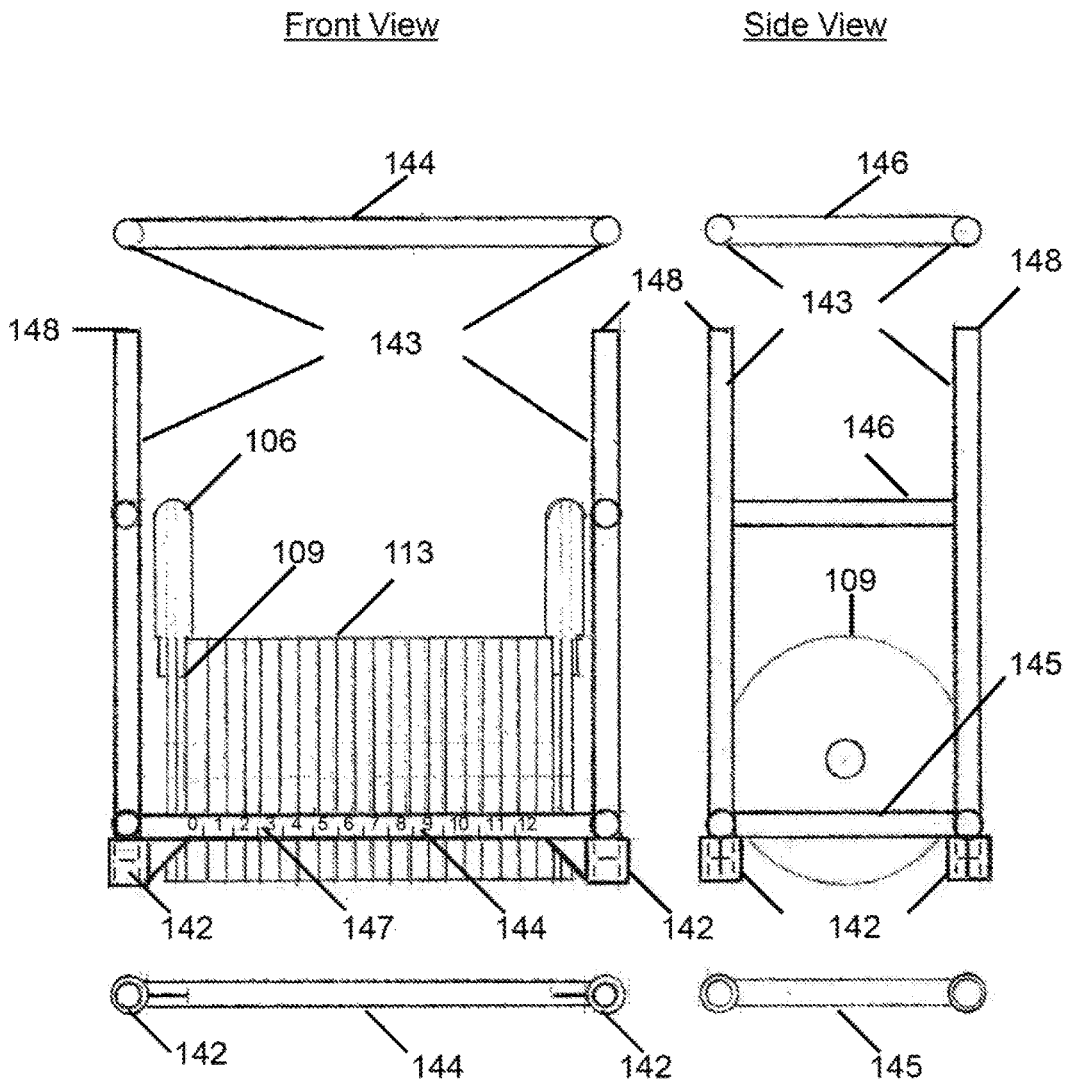

FIG. 14 is a front and side view of the stackable cradle that can carry 100 lbs (more or less) of weighted discs, upgrade weighted discs and handles that can be used as a device configuration and assembly platform with a weight calibration.

DETAILED DESCRIPTION OF THE INVENTION

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments can be used, and other changes can be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and made part of this disclosure.

Methods, systems, devices, and/or apparatus related to athletic training and/or exercise equipment are described. Some example embodiments according to the present disclosure can pertain to multiple configurations exercise device, such as multi-purpose exercise balls. The present disclosure includes, among other things, exercise devices which can be configured with none, 1 or more detachable handle(s) in a configuration including, but not limited to an 1) exercise ball (no handles), 2) kettle bell (i handle), 3) medicine ball (2 handles opposite), 4) kettle bell-2™ (2 handles near each other) and 5) dumbbell (1 handle at the side) or any combination thereof. Some example embodiments according to the present disclosure can include, among other things, exercise devices with an upgradable weight system of weighted discs of standard and/or upgrade weighted discs that can be self attaching to each disc, weighted and/or un-weighted handles that can be positioned around an axis of the device from 0 degrees to 360 degrees of rotation that can be self attaching to the weighted discs(s), end caps that can be made of rubber-like material or other material that provides a ball like appearance and/or texture for handling of the invention and connection system that can attach around and/or through the alignment shaft of the invention to provide a form of secure connectedness.

The present disclosure recognizes in health and fitness and the home gym environment, storage space for exercise and fitness equipment can be limited. This can limit or prevent the purchase of some exercise equipment, such as numerous exercise balls, medicine balls and kettle bells for the home gym, and is a primary reason why some users prefer the commercial fitness clubs to utilize the variety of this type of exercise equipment within those facilities. Some example multi-configuration upgradable fitness device can save considerable space and reduce the requirement for space by combining the space needed for numerous and varying weights of exercise balls, medicine balls and/or kettle bells into the present invention space saving footprint.

FIG. 1 illustrates an embodiment of the disclosure that can include but not limited to the configurations front view of a generally spherical shape that can be a 16.6 cm (6.5 inch) diameter r larger/smaller diameter that can have a flat bottom. 115 as an example exercise ball. 101 (no handles), kettle bell 102 (1 handle 106 at top), medicine bell 103 (2 handles 106 at opposite ends), kettle bell-2 104 (2-handles 106 near each other) and dumbbell 105 (1 handle 106 at side) with holes 133 on the surface. In some example embodiments, handles 106 of quantity (none, 1 or more) can be attached to the spherical shape as an example medicine ball 103 (2 handles), kettle bell 102 (1 handle), kettle bell-2 104 (2 handles near each other) and dumbbell 105 (1 handle at side). Some example configurations of the embodiment is constructed of hard rubber as a best mode compared to other materials as an alternative it could be constructed of plastic, metal, fiberglass, combined plastic-n-rubber or other material.

FIG. 2 illustrates an embodiment of the disclosure that can include but not limited to the configuration as a kettle bell 102 with (1 or more) handle(s) 106 at the top position that can be attached from 0 degrees to 360 degrees about an axis of the device that can include an upgradable weight system with weighted discs(s) 109 that can weigh 2.5 lbs each and accumulate at 2.5 pound increments and have an end cap(s) 108 of circular shape with a flat bottom 115 to provide a platform for standing the device upright connected together with a connection system that facilitates a variable width of the device to provide for upgradable weights.

FIG. 3 illustrates the circular 0 degree to 360 degree handle 106 attachment capability about an axis of the device as a best mode demonstrated as an exercise ball 101.

FIG. 4 illustrates an embodiment of the disclosure that can include but not limited to greater detail of the expanded view of the components of the disclosed invention that can include an 8-sided octagon shaped alignment shaft 107 as a best mode to be attached at support structure 112 through fastener hole 127 to the fastener hole 129 in the left end cap 108 and alignment shaft 107 slides through an octagon 8-sided hole 111 of the weighted handle(s) 106, through a circular hole 110 of the weighted disc(s) 109 and slide through the support structure 112 of the right end cap 108 and the device connected together by a connection system that can consist of stretch band(s) 120 with a female snap 118 with a grab loop 119 attached to the left end cap 108 though a fastener hole 124 and stretched across a variable number of weighted disc(s) 109 and handle(s) 106 to attach to the right end cap 108 at the male snap 117 to form a secure connection, combined with the connection system attraction coating 130 that can be made of adhesive/magnetic substance on one side of the disc(s) 109 the handle(s) 106 and cover plate 125 to the left end cap 108 that can be connected to the right end cap 108 by the stretch band(s) 123 of the hinge system using the female snap 122 to connect to the male snap 121 of the right end cap 108 to form a secure hinged system connection while the device is open/closed like a clam-shell where each end cap 108 has a weight calibration 116 where one inch equals 10 pounds of weighted disc(s) and handle(s) between the end caps and flat bottom 115 of the end caps 108 to provide an upright standing position.

FIG. 5 illustrates an embodiment of the disclosure that can include but not limited to the front and side view of the handle 106 that can have an attached disc 109 as a single unit that can have an attraction coating 130 that can be a single or combined element of magnetic and/or plastic and/or rubber and/or grippy material as part of the connection system with an 8-sided octagon shaped hole at center 111 is a best mode to position the handle 106 at eight positions of 45, 90, 135, 180, 225, 270, 315 and 360 degrees thought the 8-sided octagon shaped alignment shaft 107 in FIG. 4 would slide through to form part of the connection system and rubber-like material for gripping around the top and side portion of the handle 106 to support a variety of exercises.

FIG. 6 illustrates an embodiment of the disclosure that can include but not limited to the front and side view of the weighted disc(s) 109 of 2.5 lbs. that can have a attraction coating 130 that can be a single or combined element of magnetism and/or plastic and/or rubber and/or grippy material as part of the connection system and circular hole 110 that is large enough to fit through the octagon 8-side alignment shaft 107 in FIG. 4, that can be at center of the disc 109 for the alignment shaft 107 in FIG. 4 to attach through to form part of the connection system, and upgrade weighted disc(s) 113 of 5.0 lbs. that can have an attraction coating 130 from FIG. 4 similar to disc(s) 109 and circular hole 114 that can be at center for the alignment shaft 107 in FIG. 4 to slide through to form part of the connection system to securely support a variety of exercises.

FIG. 7 illustrates an embodiment of the disclosure that can include but not limited to the front and side views of the Kettle Bell-2 configuration 104 in FIG. 1 with two handles 106 near each other and one disc 109 attached as a single unit that can have an attraction coating 130 that can be a single or combined element of magnetic and/or plastic and/or rubber and/or grippy material as part of the connection system with an 8-sided octagon shaped hole 132 at center where the 8-sided octagon shaped alignment shaft 107 in FIG. 4 would slide through to form part of the connection system to support a variety of exercises.

FIG. 8 illustrates an embodiment of the disclosure that can include but not limited to the front and top views of the Medicine Ball Configuration 103 in FIG. 1 with two handles 106 opposite each other and one disc 109 attached as a single unit that can have an attraction coating 130 that can be a single or combined element of magnetism and/or plastic and/or rubber and/or grippy material as part of the connection system with an 8-sided octagon shaped hole 134 at center where the 8-sided octagon shaped alignment shaft 107 in FIG. 4 would slide through to form part of the connection system to support a variety of exercises.

FIG. 9 illustrates an embodiment of the disclosure that can include but not limited to the front, top, bottom and side views of the connection system with left end cap 108 and fastener holes 124 that attach stretch band(s) 120 with fastener 140 that has a female snap 118 that connects to male snap 117 in right end cap 108 to provide a secure flexible connection at the top, with hinge system stretch band(s) 123 that attaches with fastener 141 at the bottom of left end cap 108 that has a female snap 122 that connects to male snap 121 in right end cap 108 to form a secure flexible hinge system connection when the device is opened like a clam-shell, and provides connected expansion and/or contraction depending on the variable thickness of attached weighted disc(s) 109 in FIG. 6 and/or handle(s) 106 in FIG. 5 to support a variety of exercises.

FIG. 10 illustrates an embodiment of the disclosure that can include but not limited to the front and side view of the connection system using the 8-sided octagon shaped alignment shaft 107 that connects through fastener hole 127 to the alignment support 112 though fastener hole 129 in the left end cap 108 where the alignment shaft 107 slides in and/or out of alignment support 112 in the right end cap 108 to provide a flexible connection with variable thickness based on number of attached weighted disc(s) 109 in FIG. 6 and/or handle(s) 106 in FIG. 5 where each end cap 108 has a weight calibration 116 of one inch equals 10 pounds of weigh depending on thickness of attached disc(s) and handle(s), and a flat bottom 115 to provide a stand-up position to support a variety of exercises.

FIG. 11 illustrates an embodiment of the disclosure that can include but not limited to the front view of the connection system upgradable expansion alignment shaft 136 with an upgradable expansion sleeve that fits inside the expansion alignment shaft 136 and inside the alignment shaft 107 and connects through keyway 137 to the connector pin 138 that is connected through fastener hole 127 to fastener hole 129 in the support structure 112 of the left end cap 108 with flat bottom 115, where the expansion alignment shaft 136 sides in and/or out of the support structure 112 of the right end cap 108 with flat bottom 115, to form a flexible connection depending on the thickness of attached weighted disc(s) 109 in FIG. 6 and/or weighted upgrade discs 113 in FIG. 6 and/or handle(s) 106 in FIG. 5 to provide a secure connection for additional weights to support a wider variety of exercises.

FIG. 12 illustrates an embodiment of the disclosure that can include but not limited to the front and side view of the connection system cover plate 125 attached by (4) fastener holes 128 to (4) fastener holes 131 in the support structure 112 and around the inner support ring 139 of the end cap 108 with flat bottom 115, that can have an attraction coating 130 that can be a single or combined element of magnetic and/or plastic and/or rubber and/or grippy material as part of the connection system to support a variety of exercises.

FIG. 13 illustrates an embodiment of the disclosure that can include but not limited to the front and side views of the assembled invention as a kettle bell 102 with a weighted handle 106 of (2.5 lbs.), a weighted disc 109 of (2.5 lbs.), (4) upgrade weighted discs 113 of (5 lbs. each) totaling 20 lbs and 2.0 inch width between the end caps 108 to form a Kettle Bell configuration 102 capable of standing upright by way of the flat bottom 115 on the end caps 108. The second assembled device configuration is a Kettle Bell-2 104 with (2) weighted handles 106 of (2.5 lbs. each), (2) weighted discs 109 (2.5 lbs. each), (4) upgrade weighted discs 113 (5 lbs. each) totaling 30 lbs and 3.0 inch width (1 inch equals 1.0 pounds) between the end caps 108 to form an assembled Kettle Bell-2 configuration 104 capable of standing upright by way of the flat bottoms 115 on the end caps 108.

FIG. 14 illustrates an embodiment of the disclosure that can include but not limited to the front and side views of the Cradle for storage and assembly of the device components with (4) feet 142 attached to the vertical supports 143 and horizontal supports 144 and 145 that provide a platform to horizontally stack up-right the standard weighted disc(s) 109, upgrade weighted disc(s) 11.3, weighted handle(s) 106 that can be utilized as an assembly platform to configure and connect the (5) configurations shown in FIG. 1. and a weight calibration 147 in 10 pounds per inch (0-12 inches) along the horizontal support 144 to visually determine the amount of weight in the device configuration or storage, that also provides a means of transport with the cross bar handle 146 to move the cradle and stack cradles vertically on top of each other by way of the (4) feet 142 stacking on top of the (4) vertical supports 143 at position 148.

VARIATIONS

It is understood that variations can be made in the foregoing without departing from the scope of the invention. For example, the shape of discs could be not round or different weights and the handles could be different shapes and connection could be different size and shape.

What is claimed is:

1. An exercise device comprising: two end caps; an upgradable alignment shaft; an expansion alignment shaft; a plurality of weight discs; a plurality of weight handle discs; and a plurality of straps; wherein the plurality of weight discs and the plurality of weight handle discs are connected to a center of the upgradable alignment shaft, where the upgradable alignment shaft is further connected to one of the two end caps at one end and another of the two end caps at a second end, and wherein the plurality of straps are configured to connect a top and bottom of the two end caps together.

2. The exercise device of claim 1, wherein: said upgradable alignment shaft is configured to be an octagon shape.

3. The exercise device of claim 2, wherein: said plurality of weight discs are configured to have a central hole at a center.

4. The exercise device of claim 2, wherein: said plurality of weight handle discs are configured to have a central hole at a center.

5. The exercise device of claim 1, wherein: said upgradable alignment shaft is configured to be a circular tube shape.

6. The exercise device of claim 5, wherein: said plurality of weight handle discs are configured to have a central hole at a center.

7. The exercise device of claim 1, wherein: the two end caps have an outside and an inside; a support structure formed on the inside of the two end caps, and a fastener hole formed on the support structure, where the upgradable alignment shaft is configured to securely fit inside of the support structure of the two end caps; wherein the plurality of weight discs and the plurality of weight handle discs have a central hole, configured to allow the plurality of weight discs and the plurality of weight handle discs to be stacked upon the upgradable alignment shaft such that the upgradable alignment shaft fits through the central holes of the plurality of weight discs and plurality of weight handle discs; wherein the plurality of straps are configured to fasten the two end caps together at the bottom of the two end caps to provide a hinge and at the top of the two end caps.

8. The exercise device of claim 1, wherein: said two end caps have a contour on an outside and open surface on an inside, where a central hole and a support structure are formed on the inside of the two end caps.

9. The exercise device of claim 1, wherein: said two end caps have a contour on an outside and open surface on an inside, a central hole and a support structure formed on the inside of the two end caps, and a flat bottom forming a standing platform on the bottom of the two end caps.

10. The exercise device of claim 1, wherein: said plurality of weight discs and/or plurality of weight handle discs have an attraction coating that is composed of an adhesive or magnetic substance.

11. The exercise device of claim 1, wherein: said plurality of weight handle discs comprise a handle attached to a weight; and when in use, one of the plurality of weight handle discs is connected to the upgradable alignment shaft such that the handle is arranged near the top of the two end caps creating a kettlebell configuration.

12. The exercise device of claim 1, wherein: said plurality of weight handle discs comprise a handle attached to a weight; and when in use, one of the plurality of weight handle discs is connected to the upgradable alignment shaft such that the handle is arranged near a side of the two end caps creating a dumbbell configuration.

13. The exercise device of claim 1, wherein: said plurality of weight handle discs comprise a handle attached to a weight; and when in use, a pair of the plurality of weight handle discs are arranged opposite each other on the upgradable alignment shaft creating a 2-handle kettlebell configuration.

14. The exercise device of claim 1, wherein: said plurality of weight handle discs comprise a handle attached to a weight; and when in use, a pair of the plurality of weight handle discs are arranged opposite each other on the upgradable alignment shaft creating a medicine ball configuration.

15. The exercise device of claim 1, wherein: when in use, the exercise device has at least one of the plurality of weight discs connected to the upgradable alignment shaft to create an exercise ball configuration.

16. The exercise device of claim 1, wherein: said plurality of straps comprise an elastic material so that when connected to the two end caps at the bottom the plurality of straps enable an expandable hinge system connection and provide a clam-shell open/close format.

17. The exercise device of claim 1, wherein: said plurality of straps comprise an elastic material that is connected to the top of the two end caps by a fastener to enable a connection system.

18. The exercise device of claim 1, wherein: one of said plurality of weight handle discs comprises a kettlebell handle with a pair of handles, where the pair of handles are attached to a weight and arranged near each other; and when in use, the kettlebell handle is connected to the upgradable alignment shaft creating a kettlebell configuration.

19. The exercise device of claim 1, wherein: one of said plurality of weight handle discs comprises a medicine ball handle, where a pair of handles are attached to a weight and arranged opposite each other; and when in use, the medicine ball handle is connected to the upgradable alignment shaft creating a medicine ball configuration.

20. The exercise device of claim 1, wherein: said upgradable alignment shaft configured to connect with the expansion alignment shaft to accommodate the plurality of upgrade weight discs.

* * * * *